US008366014B2

(12) United States Patent
Ene et al.

(10) Patent No.: US 8,366,014 B2
(45) Date of Patent: Feb. 5, 2013

(54) TANK-TANKLESS WATER HEATER

(75) Inventors: Alexandru Sorin Ene, Guelph (CA); Larry Nestor Chanasyk, Belwood (CA); Don Hambly, Mississauga (CA); Dave Hammond, Cambridge (CA)

(73) Assignee: A. O. Smith Enterprises Ltd., Ontario (CA)

( * ) Notice: Subject to any disclaimer, the term of this patent is extended or adjusted under 35 U.S.C. 154(b) by 1380 days.

(21) Appl. No.: 12/015,190

(22) Filed: Jan. 16, 2008

(65) Prior Publication Data

US 2008/0197205 A1 Aug. 21, 2008

Related U.S. Application Data

(60) Provisional application No. 60/902,566, filed on Feb. 21, 2007, provisional application No. 60/972,146, filed on Sep. 13, 2007.

(51) Int. Cl.
*F24D 3/08* (2006.01)
*F24H 1/22* (2006.01)

(52) U.S. Cl. ..... 237/19; 122/20 B; 122/18.4; 122/18.5

(58) Field of Classification Search ..... 237/19; 122/20 B, 18.4, 18.5, 40
See application file for complete search history.

(56) References Cited

U.S. PATENT DOCUMENTS

| | | | | |
|---|---|---|---|---|
| 735,321 | A | 8/1903 | Walker | |
| 817,589 | A | 4/1906 | Roberts | |
| 1,107,534 | A * | 8/1914 | Lovekin | 237/19 |
| 1,540,361 | A | 6/1925 | Newell | |
| 1,555,338 | A | 9/1925 | Vaughan | |
| 1,618,735 | A | 2/1927 | Storey | |
| 1,643,223 | A | 9/1927 | O'Dowd | |
| 1,698,561 | A | 1/1929 | Ransom | |
| 1,766,068 | A | 6/1930 | De Lannoy | |
| 1,771,592 | A | 7/1930 | Summers | |
| 2,033,260 | A | 3/1936 | Sterick | |

(Continued)

FOREIGN PATENT DOCUMENTS

| | | |
|---|---|---|
| CA | 2047355 | 4/1992 |
| CN | 2412180 | 12/2000 |

(Continued)

OTHER PUBLICATIONS

International Preliminary Report on Patentability from the International Bureau on behalf of the International Searching Authority for International Application No. PCT/IB2008/000670 dated Nov. 3, 2009.

(Continued)

*Primary Examiner* — Steven B McAllister
*Assistant Examiner* — Phillip E Decker
(74) *Attorney, Agent, or Firm* — Michael Best & Friedrich LLP

(57) ABSTRACT

A tank-tankless water heater includes primary and secondary heat exchangers, and a combustor for the production of flue gases. In operation, water is first heated as the water and flue gases flow through primary heat exchanger. The water flows into the tank where it is stored and again heated as the flue gases flow through the secondary heat exchanger. A pump moves the water from the secondary heat exchanger, through the primary heat exchanger, and back to the secondary heat exchanger for storage as needed to maintain the stored water at a desired temperature. Water is drawn from the secondary heat exchanger during initial demand to provide a ready source of hot water, and the hot water supply is maintained by the primary heat exchanger during sustained hot water draws. The primary heat exchanger may include a temperature or temperature differential control system.

14 Claims, 5 Drawing Sheets

U.S. PATENT DOCUMENTS

| | | | | | |
|---|---|---|---|---|---|
| 2,190,382 | A | | 2/1940 | Moore | |
| 2,201,406 | A | | 5/1940 | Miller | |
| 2,455,988 | A | | 12/1948 | Fife | |
| 2,878,804 | A | | 3/1959 | Gaffney | |
| 2,889,444 | A | | 6/1959 | Stiebel | |
| 3,080,119 | A | | 3/1963 | Shutkufski | |
| 3,249,303 | A | | 5/1966 | Townsend | |
| 3,461,854 | A | | 8/1969 | Toni et al. | |
| 3,670,807 | A | | 6/1972 | Muller | |
| 4,037,786 | A | * | 7/1977 | Munroe | 237/19 |
| 4,178,907 | A | | 12/1979 | Sweat, Jr. | |
| 4,184,457 | A | | 1/1980 | Trotter et al. | |
| 4,257,397 | A | | 3/1981 | Gouyou-Beauchamps | |
| 4,340,174 | A | * | 7/1982 | Regan | 237/19 |
| 4,350,144 | A | | 9/1982 | Beckwith | |
| 4,408,567 | A | | 10/1983 | Morton | |
| 4,412,526 | A | | 11/1983 | DeGrose | |
| 4,438,728 | A | * | 3/1984 | Fracaro | 122/18.31 |
| 4,492,091 | A | | 1/1985 | Whitwell et al. | |
| 4,564,003 | A | | 1/1986 | Iwanicki et al. | |
| 4,567,350 | A | | 1/1986 | Todd Jr. | |
| 4,638,944 | A | | 1/1987 | Kujawa et al. | |
| 4,641,631 | A | * | 2/1987 | Jatana | 122/20 B |
| 4,678,116 | A | | 7/1987 | Krishnakumar et al. | |
| 4,699,091 | A | | 10/1987 | Waters | |
| 4,798,224 | A | | 1/1989 | Haws | |
| 4,818,845 | A | | 4/1989 | Koizumi et al. | |
| 4,852,524 | A | | 8/1989 | Cohen | |
| 4,977,885 | A | | 12/1990 | Herweyer et al. | |
| 4,993,402 | A | * | 2/1991 | Ripka | 122/18.4 |
| 5,006,689 | A | | 4/1991 | Kurachi et al. | |
| 5,020,721 | A | | 6/1991 | Horne | |
| 5,027,749 | A | | 7/1991 | Cifaldi | |
| 5,042,524 | A | | 8/1991 | Lund | |
| 5,056,712 | A | | 10/1991 | Enck | |
| 5,076,494 | A | | 12/1991 | Ripka | |
| 5,203,500 | A | | 4/1993 | Horne, Sr. | |
| 5,233,970 | A | | 8/1993 | Harris | |
| 5,317,670 | A | | 5/1994 | Elia | |
| 5,408,578 | A | | 4/1995 | Bolivar | |
| 5,479,558 | A | * | 12/1995 | White et al. | 392/485 |
| 5,584,316 | A | | 12/1996 | Lund | |
| 5,626,287 | A | | 5/1997 | Krause et al. | |
| 5,816,135 | A | | 10/1998 | Ferri | |
| 5,881,681 | A | | 3/1999 | Stuart | |
| 5,944,221 | A | | 8/1999 | Laing et al. | |
| 6,041,742 | A | | 3/2000 | Drake | |
| 6,131,536 | A | | 10/2000 | Kujawa | |
| 6,167,845 | B1 | | 1/2001 | Decker, Sr. | |
| 6,283,067 | B1 | | 9/2001 | Akkala | |
| 6,390,029 | B2 | | 5/2002 | Alphs | |
| RE37,745 | E | | 6/2002 | Brandt et al. | |
| 6,427,638 | B1 | | 8/2002 | Kolbusz et al. | |
| 6,612,267 | B1 | | 9/2003 | West | |
| 6,628,894 | B2 | | 9/2003 | Winter et al. | |
| 6,640,047 | B2 | | 10/2003 | Murahashi et al. | |
| 6,837,443 | B2 | | 1/2005 | Saitoh et al. | |
| 6,928,236 | B2 | | 8/2005 | Suzuki et al. | |
| 6,945,197 | B2 | | 9/2005 | Ryoo | |
| 6,962,162 | B2 | | 11/2005 | Acker | |
| 6,981,651 | B2 | | 1/2006 | Robertson | |
| 7,234,646 | B2 | | 6/2007 | Saitoh et al. | |
| 7,322,532 | B2 | | 1/2008 | Takada et al. | |
| 7,360,507 | B1 | * | 4/2008 | Logsdon | 122/20 B |
| 7,460,769 | B2 | | 12/2008 | Ryks | |
| 7,628,337 | B2 | * | 12/2009 | Cuppetilli et al. | 237/19 |
| 2002/0146241 | A1 | | 10/2002 | Murahashi et al. | |
| 2003/0113107 | A1 | | 6/2003 | Winter et al. | |
| 2005/0074231 | A1 | | 4/2005 | Suzuki et al. | |
| 2008/0115839 | A1 | | 5/2008 | Acker | |
| 2008/0173357 | A1 | | 7/2008 | Acker | |
| 2008/0216770 | A1 | | 9/2008 | Humphrey et al. | |

FOREIGN PATENT DOCUMENTS

| | | | |
|---|---|---|---|
| CN | 1584437 | | 2/2005 |
| DE | 4421137 | A1 * | 12/1994 |
| GB | 2 169 692 | | 7/1986 |
| JP | 57-161444 | | 10/1982 |
| JP | 07-180909 | | 7/1995 |
| JP | 2001-304691 | | 10/2001 |

OTHER PUBLICATIONS

Canadian Office Requisition for Application No. 2,667,592, dated Jan. 28, 2011, (4 pages).

* cited by examiner

TANK-TANKLESS WATER HEATER

RELATED APPLICATIONS

This application claims priority to U.S. Provisional Patent Application No. 60/902,566 filed on Feb. 21, 2007, the contents of which are incorporated herein by reference. This application also claims priority to U.S. Provisional Patent Application No. 60/972,146 filed on Sep. 13, 2007, the contents of which are incorporated herein by reference.

BACKGROUND

Generally, water heaters fall into one of two types: (i) tankless or instantaneous water heaters, and (ii) storage or tank water heaters. Each type of water heater has its advantages and disadvantages, and the decision to use one over the other for a particular application involves trade-offs in various performance issues. The present invention relates to a water heater that takes advantage of beneficial aspects of both water heater types while avoiding some disadvantages of each.

SUMMARY

In one embodiment, the invention provides a tank-tankless water heater comprising: a combustor for the production of hot flue gases; a primary heat exchanger including a core and a flue gas flow path; and a secondary heat exchanger including a tank and at least one flue. Flue gases flow from the combustor through the flue gas flow path and then through the at least one flue. Water to be heated first flows through the core, then into the tank where the water is stored, and then flows out of the tank for use upon demand. Heat is transferred from the flue gases to the water first as the water flows through the core and the flue gases flow through the flue gas flow path, and again as the water is stored in the tank and the flue gases flow through the at least one flue.

In some embodiments, the primary heat exchanger includes a primary water inlet that delivers water to be heated to the core, and a primary water outlet that delivers heated water from the core to the tank. The primary heat exchanger may be a temperature controlled heat exchanger having a flow control valve operable to selectively restrict flow of water through the core to achieve a desired water temperature at the primary water outlet. In other embodiments, the primary heat exchanger is a temperature differential controlled heat exchanger in which the temperature of water flowing through the core from the primary water inlet to the primary water outlet is raised a substantially fixed amount.

In some embodiments, the water heater also includes a water pump communicating between the tank and the core and operable to move water from the tank, through the core, and back to the tank, to heat the water and raise the temperature of water in the tank. The pump may be operable to move water from a bottom portion of the tank, then through the core, and then to a top portion of the tank. The pump may alternatively be operable to move water from a top portion of the tank, then through the core, and then to a bottom portion of the tank. A temperature sensor may be used for sensing water temperature in the tank and activating the water pump in response to the water temperature in the tank falling below a set point temperature.

In some embodiments, the water heater includes a flow activation controller operable to initiate operation of the combustor in response to water flow through the core.

In some embodiments, the water heater includes a water flow circuit operable, in response to a performance draw of hot water from the tank, to draw hot water from the tank at a first temperature, mix the hot water with cold water to produce reduced temperature water at a temperature lower than the first temperature, flow the reduced temperature water through the primary heat exchanger to produce reheated water at a second temperature substantially equal to the first temperature, and returning the reheated water to the tank.

In some embodiments, the primary heat exchanger includes a primary water inlet and a primary water outlet; the secondary heat exchanger includes a secondary water inlet communicating with the primary water outlet for receiving hot water from the primary heat exchanger, a secondary water outlet through which hot water flows out of the tank for use upon demand, and a two-way port; the water heater further comprises a tee communicating between the primary water inlet and the two-way port, and adapted to communicate with a source of cold water; upon demand replacement cold water from the source of cold water replaces hot water drawn from the tank; and at least some of the replacement cold water flows through the two-way port into the tank without flowing through the primary heat exchanger.

In some embodiments, the water heater further comprises a temperature sensor generating a signal in response to water temperature in the tank falling below a set point during continued flow of water out of the tank for use; a water pump; and a controller activating the pump in response to receiving the signal to direct an increased amount of cold water from the tee to the primary water inlet and thereby reduce the amount of cold water entering the tank through the two-way port. In some embodiments, the water heater further comprises a temperature sensor generating a signal in response to water temperature in the tank falling below a set point during continued flow of water out of the tank for use; and a controller restricting cold water flow through the bypass circuit in response to receiving the signal, to increase an amount of cold water flowing through the primary heat exchanger prior to entering the tank after the signal is generated. In some embodiments, the water heater further comprises means for increasing the flow of cold water from the tee to the primary water inlet and decreasing the flow of cold water from the tee to two-way port; wherein cold water is introduced to a bottom portion of the tank through the two-way port; and wherein water is introduced to the top portion of the tank from the primary heat exchanger.

In some embodiments, the water heater further comprises: a first sensor coupled to a lower portion of the tank for generating a first signal indicative of water temperature within the lower portion of the tank; a second sensor coupled to an upper portion of the tank for generating a second signal indicative of water temperature within the upper portion of the tank; a two-way port communicating with the lower portion of the tank; a cold water supply line communicating with both the primary water inlet and the two-way port; a proportional valve communicating between the cold water supply line and the two-way port; and a water pump communicating between the cold water supply line and the primary heat exchanger; wherein cold water flows into the tank through the two-way port during initial performance draw of hot water from the tank; wherein the water pump is energized in response to the first sensor generating the first signal, such that a portion of cold water from the cold water supply line flows through the primary heat exchanger before reaching the tank; and wherein the proportional valve restricts flow of cold water through the two-way valve in response to the second sensor generating the second signal.

In some embodiments, the water heater further comprises a flow sensor monitoring the flow of hot water during a performance draw; wherein the flow sensor causes the proportional valve to increase the flow of cold water through the two-way valve in response to the performance draw ending. In some embodiments, the pump draws water from the tank through the two-way valve, flows the water through the primary heat exchanger where the water is reheated, and returns the reheated water to the tank in the absence of a performance draw in response to at least one of the first and second signals being generated.

The invention also provides a method of heating water, comprising the steps of: (a) providing a primary heat exchanger having a core and a flue gas flow path; (b) providing a secondary heat exchanger including a tank and at least one flue; (c) producing hot flue gases; (d) moving the flue gases through the flue gas flow path and then through the at least one flue; (e) flowing water to be heated first through the core, then into the tank; (f) heating the water first in the primary heat exchanger as the water flows through the core and the flue gases flow through the flue gas flow path; and (g) after heating the water in the primary heat exchanger, storing the water in the tank and heating the water in the tank as the flue gases flow through the at least one flue.

In some embodiments, the method may also include sensing a temperature of the water stored in the tank and moving water from the tank, through the core, and back to the tank to reheat the water stored in the tank in response to the water temperature in the tank falling below a set point temperature.

In some embodiments, step (f) may include selectively restricting the flow of water through the core to achieve a desired temperature of water flowing out of the primary heat exchanger, and step (e) may include introducing water from the core into a top portion of the tank.

In some embodiments, step (f) may include raising the temperature of water flowing through the core a fixed amount, and step (e) may include introducing water from the core into a bottom portion of the tank. The method may also include the steps of (h) providing hot water from a top portion of the tank to a user; and (i) in response to step (h), moving hot water at a first temperature out of the top portion of the tank, mixing the hot water with cold water to create reduced temperature water, flowing the reduced temperature water through the core to create reheated water having a second temperature substantially equal to the first temperature, and introducing the reheated water into the bottom portion of the tank.

In some embodiments, the method may also include the following steps: (h) providing hot water from a top portion of the tank to a user; (i) in response to step (h), bypassing the primary heat exchanger to direct cold water directly into a bottom portion of the tank to replace water flowing out of the tank; (j) monitoring water temperature in the tank; and (k) diverting a portion of cold from flowing directly into the bottom portion of the tank, and flowing the diverted cold water through the primary heat exchanger and then into a top portion of the tank in response to water temperature in the tank being below a cut-out temperature.

In some embodiments, step (d) includes transferring sufficient heat from the flue gases to the water in the secondary heat exchanger to create condensation of water vapors in the flue gases in the at least one flue.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Embodiment 1

Figure 1:
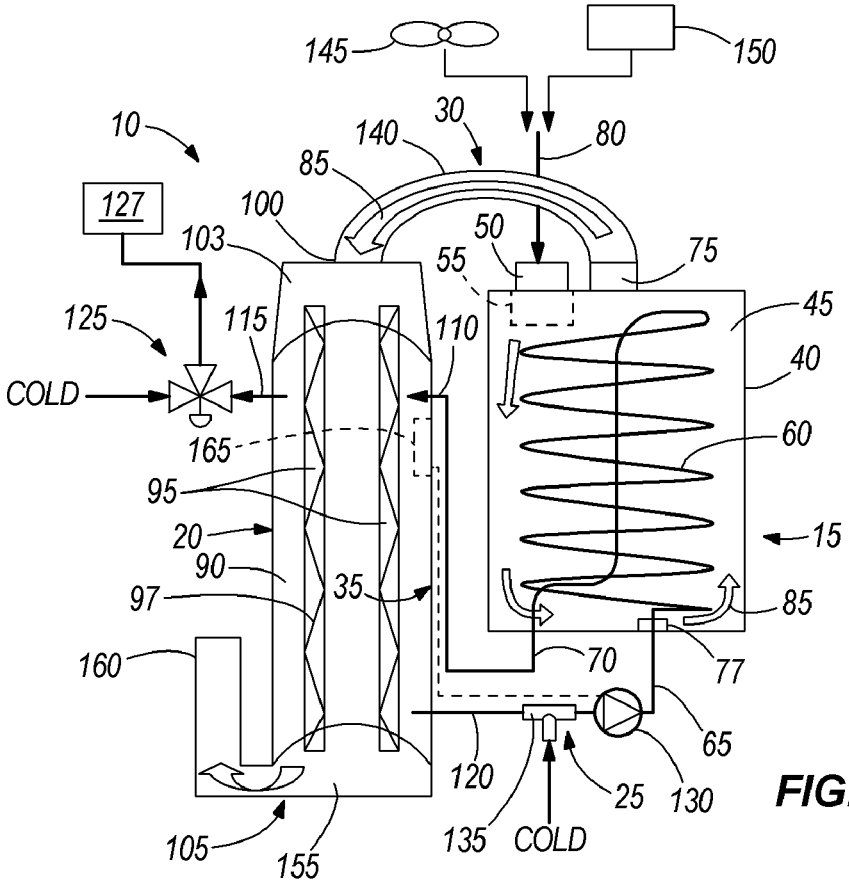
FIG. 1 is a schematic representation of a first embodiment of a water heater according to the present invention.

FIG. 1 is a schematic representation of a first embodiment of a tank-tankless water heater 10 according to the present invention. The term "tank-tankless water heater," as used herein, refers to a water heater that includes components and functionality of both general types of water heaters (tankless and tank water heaters). While the focus of the illustrated embodiments is primarily on tank-tankless water heaters for residential applications, it is within the scope of the invention to apply the structure and functionality of the illustrated embodiments to industrial, commercial, and other applications not specifically disclosed herein.

It is common to the design of storage type water heaters to have a large storage capacity and a low input rate, while by contrast tankless type water heaters have a very small storage capacity and large input rate. The present invention uses a combination of storage capacity and input rate to provide the hot water needs for a residential or commercial application covering both the dump load (large hot water draws over short periods) and continuous flow type of hot water usage patterns. It is envisioned that the water heater can define a relatively smaller size or total volume in comparison with typical storage type water heaters. It is also envisioned that the water heater may have a lower input rate in comparison with tankless type water heaters designed for the same hot water usage application, and therefore may not require upgrades of the gas distribution and metering system or special requirements regarding venting of flue gas.

The water heater 10 includes a primary heat exchanger 15, a secondary heat exchanger 20, a water circuit 25, a flue gas circuit 30, and a control system 35. The entire water heater 10 may be enclosed in a water heater outer casing in some embodiments. Following is a detailed description of the water heater 10, which is then followed by descriptions of alternative embodiments of the invention. For the sake of brevity, it is to be understood that aspects of each embodiment may be incorporated into the other embodiments, and vice-versa, without specific reference to same in this written description. Indeed, where elements are similar in the various embodiments, the same reference numerals are used in the drawings, despite such elements not always being referenced in the written description for all of the embodiments.

Primary Heat Exchanger

In the illustrated embodiment, the primary heat exchanger 15 includes a tankless water heater, which may also be referred to as the "heat engine" of the water heater 10. The primary heat exchanger 15 includes an enclosure 40 defining an interior space 45, a fuel and air intake 50, a combustor or combustion system 55, a primary heat transfer core 60 within the interior space 45, a primary water inlet 65, a primary water outlet 70, and a primary exhaust 75. The primary core 60 is adapted for the flow of water therethrough, and is shown schematically as a single coil. In other embodiments, the primary core 60 may include one or more finned tubes, coils, and/or fin-type heat exchangers.

The primary heat exchanger 15 may be of the temperature controlled type, and may include a flow control valve 77. The flow control valve 77 may be used to slow down the flow of water through the core 60. As water flow rate in the core 60 is reduced, residence time of water in the core 60 is increased, and more heat is transferred to the water. With proper operation of the flow control valve 77, the temperature controlled primary heat exchanger 15 may deliver water at the primary water outlet 70 at a desired temperature (e.g., 140°-150° F. or higher depending on the application) without regard to the temperature of the water flowing into the primary water inlet 65.

The combustor 55 is illustrated within the enclosure for example, but may be inside or outside of the enclosure 40 in other embodiments. The combustor 55 may include a fixed input type or a modulating input type combustion system. If the combustor 55 includes a modulating input type, it can be used in conjunction with the flow control valve 77 to provide water at a desired temperature at the primary water outlet 70 (i.e., both water flow rate and combustor input rate can be adjusted to achieve the desired result). The combustor or combustion system 55 may be designed based on low NOx principles as well as high combustion and heat transfer efficiency.

Air and fuel are drawn into the primary heat exchanger 15 via the air and fuel intake 50, to create an air/fuel stream 80. The air/fuel stream 80 may be partially premixed or fully premixed. The air/fuel stream 80 is combusted in the combustor 55 to produce products of combustion or flue gases 85. The interior space 45 may be divided or partitioned to cause flue gases 85 to travel across one side of the core 60, and then back along an opposite side of the core 60 in a double-pass configuration. Water to be heated flows into the primary core 60 through the primary water inlet 65. The flue gases 85 follow a flue gas flow path through the interior space 45 over the primary core 60, and heat is transferred from the flue gases 85 to the water flowing through the primary core 60. As heat is transferred to the water in the primary core 60, the water temperature rises and the enclosure 40 and heat exchange surfaces (e.g., fins and the like) in the primary core 60 are cooled. Proper water flow control reduces the likelihood of local boiling in the primary core 60, which facilitates higher heat flux density in the interior space 45. The flue gases 85 flow out of the primary exhaust 75, and the now-heated water flows out of the primary water outlet 70.

Secondary Heat Exchanger

The secondary heat exchanger 20 includes a tank-type water heater having a tank 90, one or more flues 95 within the tank 90, optional baffles 97 in the flues 95, a flue gas inlet 100, an optional plenum 103, a secondary exhaust 105, a secondary water inlet 110, a secondary water outlet 115, and a two-way port 120. The flue gases 85 flow through the flue gas inlet 100, into the plenum 103, through the flues 95, and out the secondary exhaust 105 to the atmosphere. The plenum 103 evenly distributes the flue gases 85 into the flues 95. The baffles 97 increase dwell time of the flue gases 85 in the secondary heat exchanger 20 and enhance the heat transfer to water through the flue walls. The baffles 97 can be embedded in the flue walls, or placed inside the flue 95 passageway with no permanent contact to the flue walls.

Water flows into the tank 90 through the secondary water inlet 110, and is heated by heat transfer from the flue gases 85 through the flue walls. Upon demand during a performance draw, the water in the tank 90 flows out through the secondary water outlet 115, is selectively mixed with cold water at a mixing valve 125 to achieve the desired temperature, and is delivered to a user at a hot water outlet or faucet 127. The tank thermostat set point temperature may be higher than the mixing valve set-point temperature (e.g. by about 10° F.) and also the tankless set-point (for a temperature controlled tankless heat exchanger) may be higher than the tank thermostat set point (e.g. by about 10° F.).

Water Circuit

The water circuit 25 includes a circulating pump 130, the tank 90, the two-way port 120, a tee 135, the primary water inlet 65, the primary core 60, the primary water outlet 70, and the secondary water inlet 110. When activated, the circulating pump 130 draws water from the tank 90 (e.g., from the bottom of the tank in the illustrated embodiment) through the two-way port 120 and tee 135, and introduces it into the primary heat exchanger 15 through the primary water inlet 65. Heat is transferred to the water as it flows through the primary heat exchanger 15 in the primary core 60. The water, still moving under the influence of the pump 130, flows out of the primary heat exchanger 15 through the primary water outlet 70, and returns to the top of the tank 90 (through the secondary water inlet 110).

Flue Gas Circuit

The flue gas circuit 30 includes the interior space 45 around the primary core 60, the primary exhaust 75, a flue gas circulation tube 140, the flue gas inlet 100, the plenum 103, the flues 95, and the secondary exhaust 105. Air for the air/fuel stream 80 comes from the atmosphere surrounding the primary heat exchanger 15. In some embodiments the air may be provided at higher-than-atmospheric pressure or the flue gases 85 may be flow-assisted by a fan, blower, compressor or other air moving device 145 communicating with the flue gas circuit 30, upstream of the air and fuel intake 50 (as illustrated), or at the secondary exhaust 105. In some embodiments, the primary heat exchanger 15 may include its own dedicated fan, but fans in most known tankless water heaters may be insufficiently sized to push flue gases through the entire water heater system 10 contemplated by the present invention. The air moving device 145, whether at the air and fuel intake 50, the secondary exhaust 105, or somewhere in between in the flue gas circuit 30, may be used to assist and supplement any dedicated fan in the primary heat exchanger 15.

The fuel may, for example, be natural gas, propane, or another combustible substance, and is supplied by a source of fuel 150. The air/fuel stream 80 is combusted to form the flue gases 85, which flow through the primary heat exchanger 15 as discussed above. Upon exiting the primary heat exchanger 15 through the primary exhaust 75, the still-hot flue gases 85 flow into the flue gas inlet 100 through the flue gas circulation tube 140. As they flow through the flues 95, the flue gases 85 transfer heat to the water in the tank 90 as discussed above, and are exhausted to the atmosphere through the secondary exhaust 105. The secondary exhaust 105 may include a chamber 155 under the tank 90 and an exhaust stack 160.

The embodiment illustrated in FIG. 1 has the flue gas inlet 100 at the top of the secondary heat exchanger 20, multiple flues 95, and the secondary exhaust 105 at the bottom of the tank 90, but other configurations of the flue gas inlet 100, flue or flues 95, and secondary exhaust 105 are within the scope of the invention. In other embodiments, the tank 90 and flues 95 may be turned sideways such that their longitudinal extents are substantially horizontal. Also, while the flues 95 illustrated in FIG. 1 are internal to the water tank 90, it is possible to utilize a space around the outside of the tank 90 as the flue or flues 95, such that the flue gases 85 heat water in the tank 90 through the tank wall. Whether the flues 95 are internal or external, they are deemed "associated with the tank" for the purposes of this written description and the appended claims.

Depending on its design, the secondary heat exchanger 20 can reduce the flue gas 85 temperature down to or under the dew point of water vapors contained in the flue gas 85. This would recover the latent heat of condensation of the water vapors, which may give rise to a relatively higher overall thermal efficiency of the water heater 10, and may qualify the water heater 10 as a high efficiency water heater. To accommodate condensation, the flue surfaces over which the flue gases 85 flow may be protected against water corrosion by means of one or more protective coatings (e.g. glass lining). If the flue gases 85 are sufficiently cool at the secondary exhaust 105, the stack 160 may be constructed of a low-temperature and relatively inexpensive material such as PVC. Also, the exhaust structure 105 may include a condensate drain trap to collect condensed water in the secondary heat exchanger flues 95. The secondary exhaust 105 (and particularly the stack 160 portion) at least partially defines the lowest temperature zone in the water heater 10.

Control System

The control system 35 includes a thermostat/controller 165 that monitors the water temperature within the tank 90. The thermostat/controller 165 may include a temperature probe extending into the water in the tank 90. In some embodiments, a thermostat or other temperature sensor may be provided in each of the top (or "upper") and bottom (or "lower") portions of the tank 90 to generate signals related to the water temperature in the upper and lower portions of the tank 90, respectively. The thermostat 165 activates the pump 130 when water temperature within the tank 90 drops below a set point. The combustor 55 may be activated directly by the thermostat 165, or by a flow sensor in the core 60 or another portion of the water circuit 25 such that the combustor 55 activates in response to water flowing through the primary core 60 under the influence of the pump 130. In some embodiments, the controller 165 may control the combustor 55 (e.g., if the combustor 55 is an input modulation combustor), the flow control valve 77, and any blowers, fans, or other air-moving device 145 communicating with the flue gas circuit 30, or a separate controller may be provided for those functions.

In some embodiments, the water heater 10 can include a flow sensor or flow switch upstream of the mixing valve 125 to monitor the state of the hot water draw. When the draw ends, a controller can activate the pump 130 (i.e., activate the water circuit 25). As a result, water can recirculate from the storage tank 90 through the primary heat exchanger 15 and back to the storage tank 90 until the water temperature in the storage tank 90 has recovered a desired temperature after a performance draw.

Operation

There are two basic modes of operation for the water heater: standby mode (which also includes initial start-up, when the entire system is originally filled with cold water) and performance draw mode. In both modes, a call for heat is generated by the thermostat/controller 165 in response to sensing a drop in water temperature in the tank 90 below a first limit temperature, and the pump 130 activates in response to receiving the call for heat from the thermostat/controller 165.

In performance draw mode, hot water is delivered to the fixture 127 from the storage tank 90. Cold water flows into the tank 90 through the two-way port 120 from the tee 135 to replace water being drawn from the tank 90. As the performance draw continues, more cold water enters the bottom of the tank 90, and the water temperature in the tank 90 decreases. If the water temperature in the tank 90 drops below the first limit temperature, the call for heat is generated and the pump 130 is activated.

Once the pump 130 is activated, the cold water at the tee 135 follows the path of least hydraulic resistance, either directly into the bottom of the tank 90 through the two-way port 120 or through the primary heat exchanger 15. The split in-between the two streams is done automatically based on the hydraulic resistance of both water paths. The flow sensor embedded into the heat engine 15 detects the flow from the pump 130 and starts the combustion system 55; as a result the primary heat exchanger 15 will start generating hot water and returning it to the storage tank 90 through the secondary water inlet 110. In this regard, starting the pump 130 is equivalent to starting operation of the primary heat exchanger 15 because the combustor 55 is flow-activated. The tank 90 acts as a buffer between the end user and the primary heat exchanger 15. Thus, cold or partially heated water (e.g., cold sandwiches or initial cold water flow prior to the combustor 55 starting) flowing from the primary heat exchanger 15 into the secondary heat exchanger 20 mixes with hot water in the tank 90 prior to flowing out through the secondary water outlet 115.

While the combustion system 55 is in operation, the flue gases 85 leaving the heat engine 15 are still hot (e.g., 350° F.) and their heat will be recovered by passing them through the secondary heat exchanger flue path 95. In order to extract the latent heat of condensation from the water vapor contained in the flue gas 85 (and boost the overall efficiency of the system), the flue stream 85 needs to leave the storage tank 90 through its lower portion (where water stored in the tank 90 will be colder as a result of the natural tank temperature stratification). The flue tube 95 wall in that lower tank area needs to have a temperature below the dew point of the flue gas 85 contained water vapors in order to promote condensation.

A temperature monitor in the primary heat exchanger 15 provides feedback to the combustor 55 as to the temperature of water at the primary water outlet 70. If temperature at the primary water outlet 70 is below a target temperature, the combustor's input rate is increased (if it is a modulated unit). If the primary heat exchanger 15 requires an input rate that is larger than the maximum input rate of the combustor 55, then the water flow control valve 77 will start to restrict the flow through the core 60. The flow control valve 77 increasingly restricts flow until the target temperature is achieved at the primary water outlet 70. As the flow control valve 77 restricts flow, the water flow rate circulated by the pump 130 will be lower than the maximum one allowed by the hydraulic resistance of the system.

Cold water entering the water heater 10 will naturally follow the path of least hydraulic resistance, and thus some cold water will likely flow into the tank 90 through the two-way port 120 even when the pump 130 is running. As the hydraulic resistance through the primary heat exchanger 15 increases, however, the amount of cold water flowing into the tank 90 through the two-way port 120 increases as a percentage of total cold water flowing into the water heater 10. Unless the demand for hot water at the faucet 127 is decreased, the water heater 10 will eventually run out of hot water, and the performance draw will need to be stopped to permit the water heater to recover. The water heater 10 recovers by running the pump 130 following a performance draw, such that water and flue gases cycle through the primary heat exchanger 15 and secondary heat exchanger 20.

The end of the call for heat occurs when the monitored temperature in the storage tank 90 exceeds a second limit temperature, which is greater than the first limit temperature by a selected differential (e.g. 10° F.). The pump 130 is deactivated in response to the end of the call for heat, which in turn deactivates the combustion system 55 of the heat engine 15. The heat engine 15 will not operate if the pump 130 does not operate.

During standby mode, the heat engine 15 is used to recharge the storage tank 90 with hot water. When the system enters this heating mode, the pump 130 draws water from the storage tank 90 through the two-way port 120, circulates the water through the heat engine 15, and returns it at the secondary water inlet 110. In standby mode, the heat engine 15 operates at the maximum flow rate (i.e., the flow control valve 77 does not restrict the flow), allowed by the hydraulic resistance of the heat engine and connecting pipes.

In view of the above, the two-way port 120 serves two purposes in the water circuit 25. During initial performance draw, before the pump 130 is activated, substantially all hot water leaving the tank 90 is replaced with cold water through the two-way port 120. Cold water also continues to flow into the tank 90 if the pump 130 is not keeping up with the demand for hot water. Because the cold water flows directly into the tank 90 through the two-way port 120 (and does not have to flow through the primary heat exchanger 15) under such circumstances, the port 120 acts as a bypass circuit with respect to the primary heat exchanger 15. During standby, when the tank is being recharged with hot water, the pump 130 draws cold water out of the tank through the port 120, and in this regard the port acts as a recirculation water outlet.

Water heaters according to the present invention may include improved thermal efficiency over known tank and tankless water heaters. More specifically, the water heater can operate with an efficiency of about 90% or more. The water heater can also replace current water heaters including power vent, conventional vent, and direct vent water heaters. The water heater can also include relatively short recovery times in comparison to standard storage tank water heaters. Some features of the water heater include continuous hot water delivery for reasonable flow rates (e.g. 2.5 GPM). Another feature is the incorporation of intelligent controls that allow an optimized use of the water heater either directly for hot water domestic applications or as a heat source for use in combination applications (e.g. convective or radiant space heating and hot water delivery). The water heater is envisioned as having various advantages over standard tank-type water heaters, such as a larger first hour rating (the amount of hot water that can be delivered in one hour), and defining a smaller size or storage capacity.

The water heater is also envisioned as having various advantages in comparison to standard tankless type water heaters. For example, some of the advantages include eliminating hot water temperature spikes, which are generally common in tankless type water heaters. This measure can reduce scalding hazards associated with tankless water heaters. Another advantage of the water heater is the water heater not being limited to a maximum flow rate. The water heater according to the present invention is capable of accommodating dump loads. Other advantages include better initial performance for low incoming cold water temperature, due to a small storage buffer, and increasing the lifetime of the tankless water heater component by using stored hot water for consumption patterns involving short draws. Another advantage includes relatively lower installation costs by using PVC for the venting system.

The inventive features of the water heaters described in this application allow the described water heaters to differ from previous storage-tank water heater designs through the use of a compact primary heat exchanger with controlled water circulation and high intensity (heat rate/volume) combustion system, having the tank-type component of the system to act as both a condensing heat exchanger and a buffer tank. Additionally, previous condensing tankless type water heaters generally have a secondary heat exchanger of a tankless type (coil type or fin-type). Thus, these previous tankless type water heaters differ from the water heaters described herein because the tank-tankless water heaters comprise a heat exchanger acting as a storage buffer tank and as secondary heat exchanger.

Other features of the water heaters in this application are that the tankless water heater can deliver water at controlled temperatures or control the temperature rise of the water. In other words, the tankless heat exchanger can control the differential between incoming cold water and the hot water delivered by means of fuel/air ratio and/or water flow rate modulation. The tankless water heater can act as a heating source transforming the chemical energy from the fuel in heat and also as primary heat exchanger. The primary heat exchanger can be a fin tube type heat exchanger, in which water flows through tubes and flue gas flows over the fins on the outside the tubes. Such a heat exchanger is able to transfer large amounts of heat from the flue gas to the water flowing through the primary heat exchanger.

A water heater according to the present invention may be modular (tankless water heaters of different inputs may be combined with storage tanks of different capacities to accommodate various hot water application). Also envisioned is the use of multiple tankless water heaters in parallel connected to a single storage tank or a single tankless water heater connected to multiple storage tanks in parallel.

Other Illustrated Embodiments

FIGS. 2, 3, 4, 5, and 6 illustrate respective second, third, fourth, fifth, and sixth embodiments of the invention. These embodiments employ much of the same structure and have many of the same properties as the embodiment of the invention described above in connection with FIG. 1. Where similar or identical features to the first embodiment are employed, the same reference numerals appear in the drawings. The following description focuses primarily upon the structure and functionality in these embodiments that are different from the first embodiment. It should be noted that elements of any embodiment disclosed herein may in appropriate circumstances be applied to or used within other embodiments.

Figure 2:
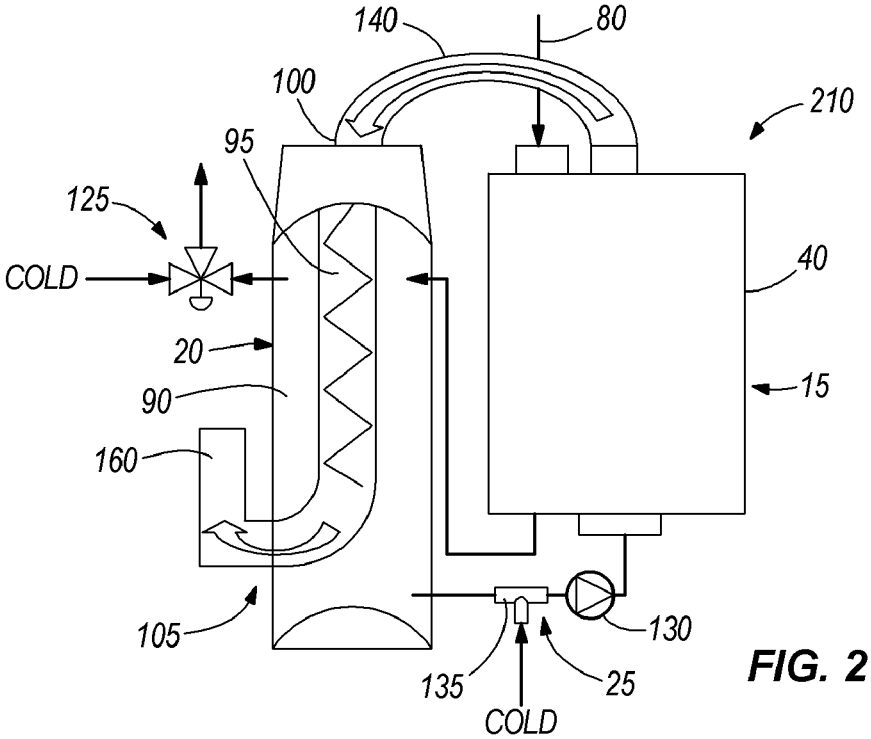
FIG. 2 is a schematic representation of a second embodiment of a water heater according to the present invention.

FIG. 2 illustrates a water heater 210 having a secondary heat exchanger 20 with a single flue 95 and the secondary exhaust 105 in a side of the tank 90, but is otherwise set up in a substantially similar manner as the water heater 10 of the first embodiment.

Figure 3:
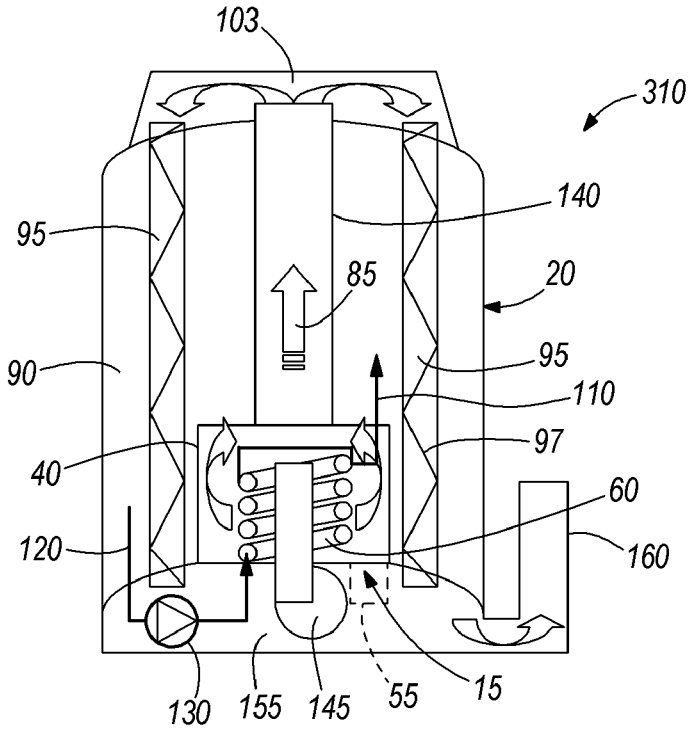
FIG. 3 is a schematic representation of a third embodiment of a water heater according to the present invention.

FIG. 3 illustrates a water heater 310 in which the primary heat exchanger 15 is at least partially within the water tank 90. In the illustrated embodiment, all but the bottom of the heat exchanger enclosure 40 is covered with water in the tank 90. In other embodiments, more or less of the enclosure 40 may be submerged within the tank than is illustrated schematically in FIG. 3. The secondary water inlet 110 is illustrated as being at the top of the primary heat exchanger 15, but not at the top of the tank 90. A dip tube can be used to deliver the water to the top of the tank 90.

The flue gas circulation tube 140 in this third embodiment includes a vertical rise from the submerged primary heat exchanger enclosure 40 up through the water in the tank 90 to the plenum 103. In the plenum 103, the flue gases 85 turn down into the flues 95 of the secondary heat exchanger 20. The vertical rise of the flue gas circulation tube 140 provides some heat transfer from flue gases 85 to the water in the tank 90, and in that regard may be deemed one of the flues 95. The vertical rise 140 may be centered within the tank 90 as illustrated, or may be off-center in other embodiments. The air moving device 145 in this embodiment includes a blower to assist the flow of flue gases 85 up through the vertical rise and back down through the flues 95. The combustor 55 and blower 145 in this embodiment may be within the chamber 155 under the tank 90.

Figure 4:
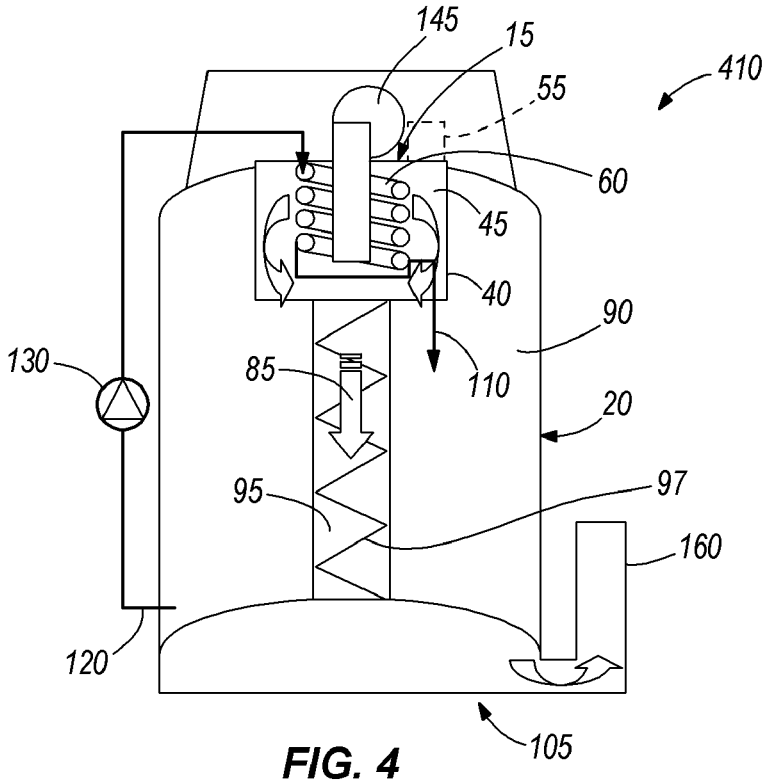
FIG. 4 is a schematic representation of a fourth embodiment of a water heater according to the present invention.

FIG. 4 illustrates a water heater 410 in which the primary heat exchanger 15 is at least partially submerged at the top of the water tank 90. As illustrated, the secondary water inlet 110 is generally in the middle portion of the tank 90 with this construction. The blower 145 in this embodiment forces the flue gases 85 down through the single flue 95 in the secondary heat exchanger 20. The combustor 55 in this embodiment may be above the tank 90. Because the flue 95 communicates directly with the interior space 45 of the enclosure 40 in this embodiment, there is no flue gas circulation tube 140.

Figure 5:
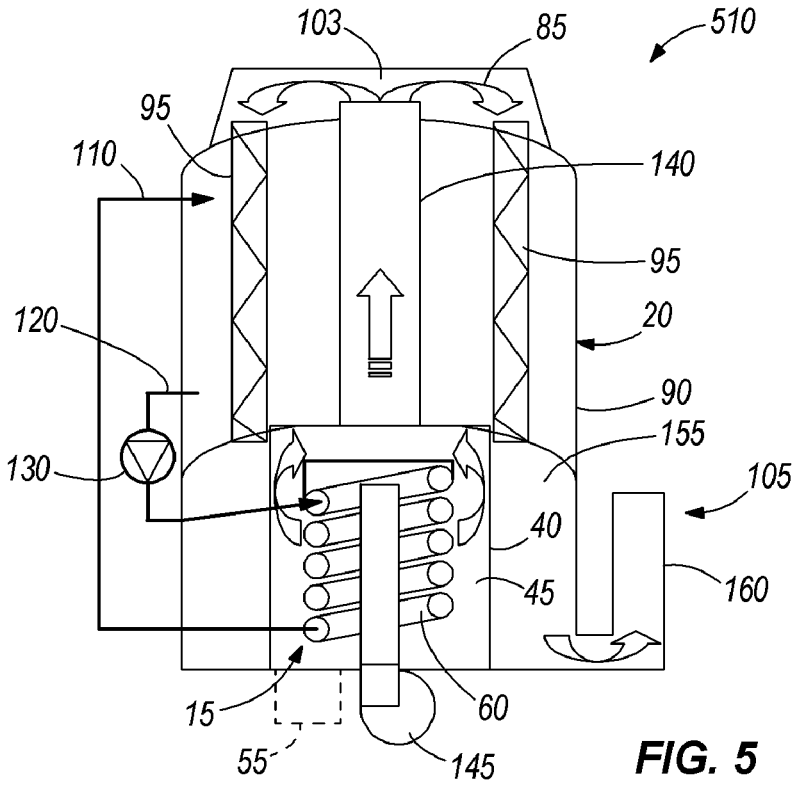
FIG. 5 is a schematic representation of a fifth embodiment of a water heater according to the present invention.

FIG. 5 illustrates a water heater 510 similar in all respects to the embodiment 310 illustrated in FIG. 3, except that the primary heat exchanger 15 is not submerged, but is within the chamber 155 under the tank 90. Also, in this embodiment, the secondary water inlet 110 may be in the top portion of the tank 90.

Figure 6:
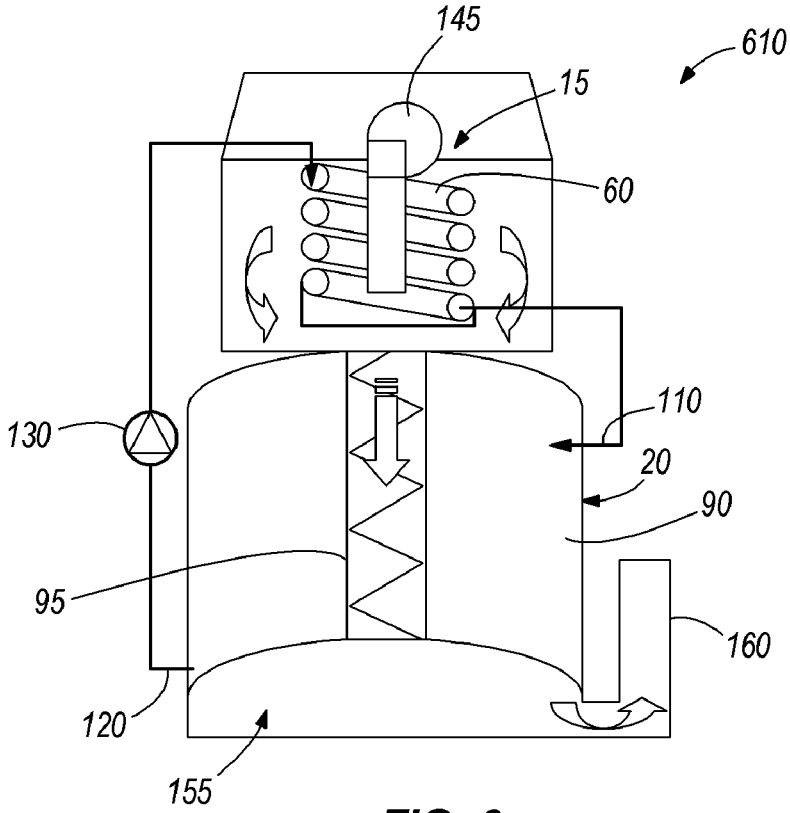
FIG. 6 is a schematic representation of a sixth embodiment of a water heater according to the present invention.

FIG. 6 illustrates a water heater 610 similar in all respects to the embodiment 410 illustrated in FIG. 4, except that the primary heat exchanger 15 is not submerged, but is above the tank 90. Also, in this embodiment, the secondary water inlet 110 may be in the top portion of the tank 90.

Alternative Water Circuit

Figure 7:
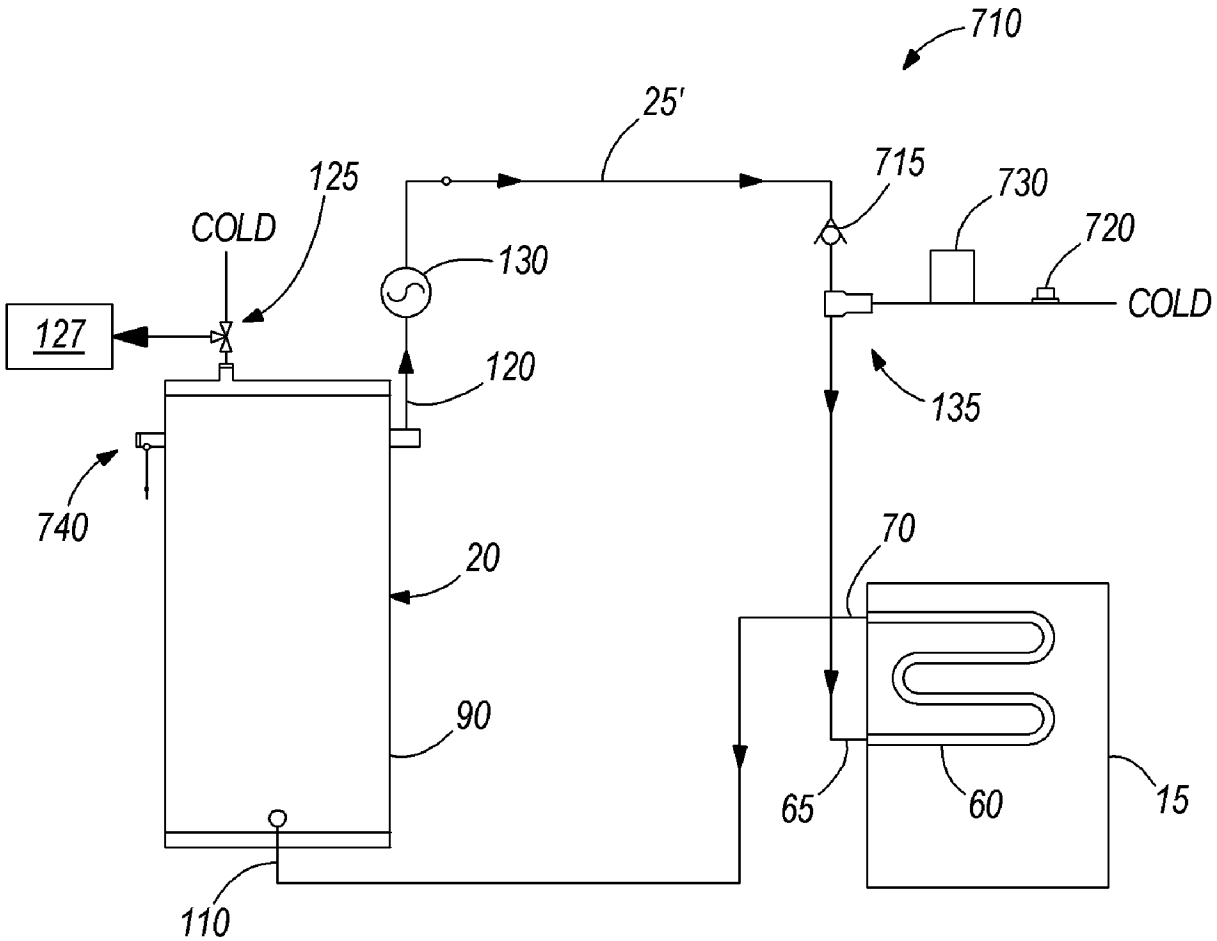
FIG. 7 is a schematic representation of an alternative water circuit according to the present invention.

FIG. 7 illustrates a water heater 710 embodying the present invention and including a first alternative water circuit 25' for use with a non-temperature controlled primary heat exchanger 15. A non-temperature controlled primary heat exchanger raises the temperature of water by a substantially fixed amount for each pass through the core 60, and may thus be referred to as a temperature differential controlled heat exchanger. Thus, the temperature of water flowing out of the primary water outlet 70 will be warmer than it was when it flowed into the primary water inlet 65 by a substantially fixed amount. Stated another way, the temperature of water flowing out of the primary water outlet 70 is a function of or dependent on the temperature of the water when it flowed into the primary water outlet 65 in a non-temperature controlled primary heat exchanger 15. In one example, the primary heat exchanger 15 may raise the temperature of water 40°-50° F. as it flows through the core 60 from the primary water inlet 65 to the primary water outlet 70. This is a relatively small temperature increase when compared to a temperature controlled primary heat exchanger, such as those described above with respect to other embodiments.

Because the primary heat exchanger 15 raises the temperature of water flowing through it by only a relatively small amount, water must be cycled through the primary heat exchanger 15 multiple times to raise the temperature of water in the tank 90 to a desired temperature. Each cycle adds a substantially fixed temperature rise to the water, and eventually the water in the tank 90 is at a temperature suitable for use (e.g., 140°-150° F. or higher for some applications).

The water circuit 25' provides a substantially uniform water temperature throughout the tank 90, which maximizes hot water in the tank 90. More specifically, in the water circuit 25', the secondary water inlet 110 communicates with the bottom of the tank 90 and the two-way port 120 communicates with the top of the tank 90. Thus, the water circuit 25' draws hot water from the top of the tank 90, raises the water temperature as it flows through the core 60, and returns the water to the bottom of the tank 90. The hot water delivered at the bottom of the tank 90 rises toward the top of the tank 90 by means of buoyancy and helps ensure the mixing process.

During a performance draw, hot water is drawn from the tank 90, mixed with cold water at the mixing valve 125, and delivered to the user at the hot water outlet or faucet 127 as discussed above. In this embodiment, however, the pump 130 is activated upon initiation of a performance draw, and hot water is simultaneously drawn from the top of the tank 90 through the two-way outlet 120. The hot water flows from the two-way port 120 through the tee 135 where it is mixed with cold water, such that the hot/cold mixture flows into the primary heat exchanger 15 at a reduced temperature (i.e., reduced temperature water at a temperature that is lower in temperature than the hot water by a fixed amount). The reduced temperature water then flows through the primary heat exchanger 15, where its temperature is raised by the fixed amount to produce reheated water (i.e., water that has been heated to substantially the same temperature as the hot water drawn off the tank), and is returned to the bottom of the tank 90. A check valve 715 may be employed between the tee 135 and the secondary heat exchanger 20 to prevent backflow of cold water into the top of the tank 90.

In one example, if the non-temperature controlled primary heat exchanger 15 raises water about 40° F. (i.e., this is the "fixed amount" referred to above), and if water at the top of the tank 90 (i.e., the "hot water" referred to above) is at a temperature of about 140° F., then cold water introduced at the tee 135 should lower the water temperature by about 40° F. to about 100° F. (i.e., the "reduced temperature water" referred to above), so that the primary heat exchanger 15 can subsequently raise the water temperature back to 140° F. (i.e., create the "reheated water" referred to above), such that the temperature of water returning to the tank 90 is at the desired temperature of 140° F. It may be desirable in some applications to provide the reduced temperature water at a temperature that is lower in temperature than the hot water by less than the fixed amount (i.e., provide reduced temperature water at higher than 100° in the example give), such that reheated water leaving the primary heat exchanger 15 is above the temperature of the hot water drawn off the top of the tank 90 (i.e., the reheated water is at a temperature in excess of 140° F.) to offset the cooling effect of mixing the reheated water with potentially cooler water at the bottom of the tank 90.

During standby, the pump 130 is activated when water in the tank 90 cools below a set point. The combustor in the primary heat exchanger 15 may be flow activated such that it automatically starts in response to water flow through the core 60. The pump 130 continues to operate until the water in the tank 90 has reached a desired temperature; this may require one or more cycles of water flowing through the primary heat exchanger and back to the bottom of the tank 90.

One advantage of the water circuit 25' is that it provides a substantially constant flow of water into the tank 90 because it does not use a flow restricting valve in the primary heat exchanger 15. Thus, the pump 130 can be smaller and use less power than in other embodiments. One disadvantage of the alternative water circuit 25' is that it less accurately controls the temperature of water than other embodiments using temperature controlled primary heat exchangers. Thus, the mixing valve 125 may need to accommodate wider fluctuations in water temperature from the tank 90 to accurately control water temperatures at the hot water outlet 127. The water heater 710 also requires a larger capacity tank 90 in the secondary water heater 20 to accommodate temperature fluctuations at the secondary water inlet 110 arising from a less accurate primary heat exchanger.

This embodiment and all other embodiments described may include additional elements, such as a pressure regulator 720 to control pressure of water from a cold water source, and expansion tank 730, and a temperature and pressure (T&P) relief valve 740 coupled to the tank 90.

Alternative Control System

Figure 8:
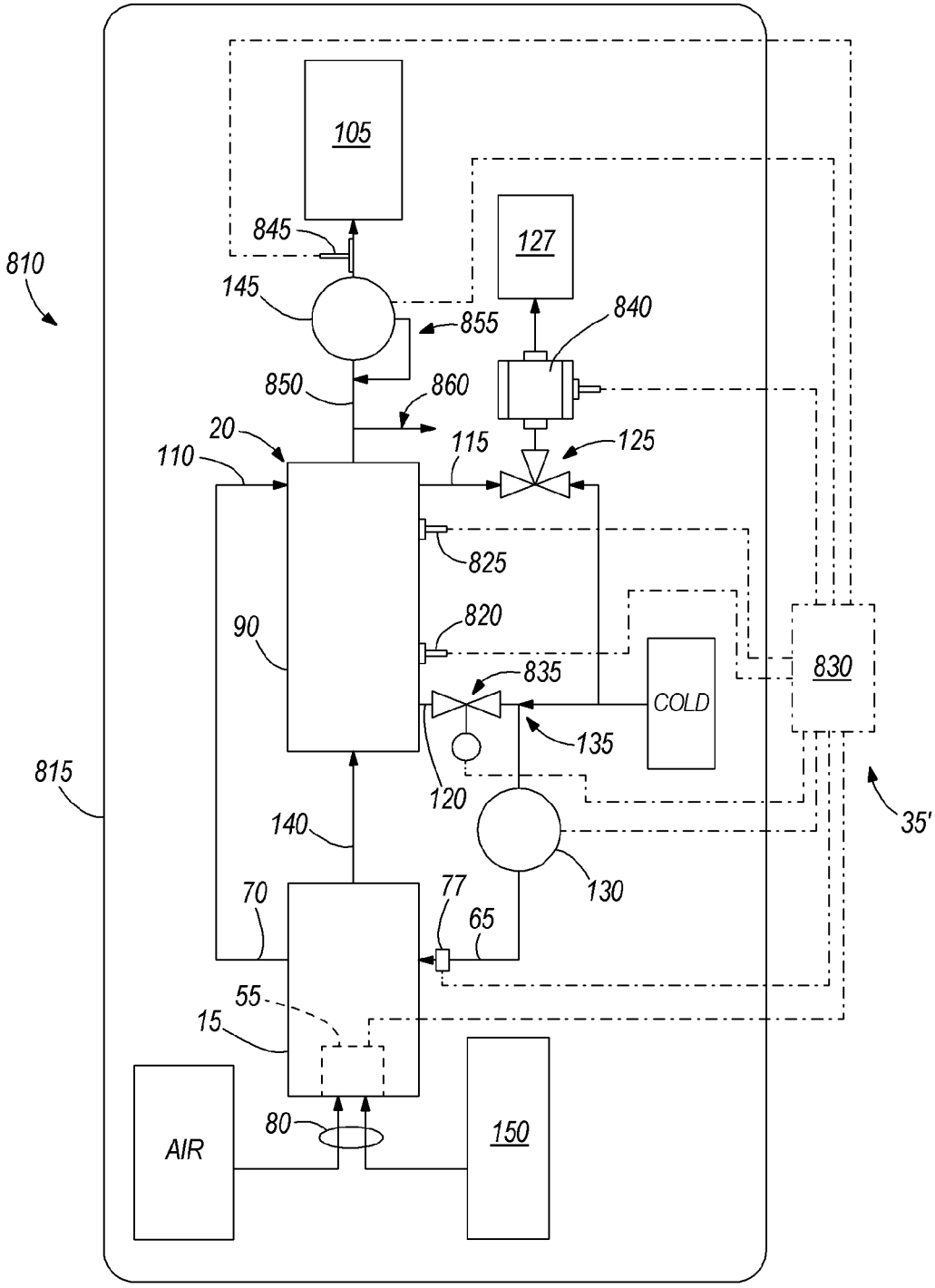
FIG. 8 is a schematic representation of an alternative control system according to the present invention.

FIG. 8 illustrates a water heater 810 embodying the present invention and including an alternative control system 35'. The water heater 810 includes an outer casing 815 enclosing the primary heat exchanger 15 and the secondary heat exchanger 20 (as stated above, a similar casing may be applied to any previously-described embodiment as well). The alternative control system 35' includes a first temperature sensor 820 mounted in a lower portion of the tank 90, a second temperature sensor 825 mounted in an upper portion of the tank 90, a controller 830, a proportional valve 835, a flow sensor 840, and a high limit switch 845.

During a performance draw, hot water is initially drawn from the top of the storage tank 90 of the secondary heat exchanger 20. Hot water from the storage tank 90 is selectively mixed with cold water in the mixing valve 125 to achieve a requested temperature at the hot water outlet 127. The flow of water out of the water heater 810 to the faucet 127 is monitored by the flow sensor 840.

As hot water is initially drawn out of the storage tank 90, the proportional valve 835 is wide open. Cold water follows the path of least resistance at the tee 135 and flows directly into the bottom of the tank 90 through the two-way port 120. Consequently, water drawn from the tank 90 is replaced with cold water introduced into the bottom of the storage tank 90. When the first temperature sensor 820 senses that the water temperature at the bottom of the tank 90 has fallen below a first temperature limit, the first temperature sensor 820 generates a first signal to the controller 830. In response to receiving the first signal, the controller 830 activates the pump 130, such that cold water is directed from the tee 135 through the primary heat exchanger 15 and into the top of the tank 90. The primary heat exchanger 15 is temperature controlled, and restricts flow of cold water with the flow restrictor 77 when the combustor 55 is unable to meet the input rate required of the primary heat exchanger. The controller 830 may also control the flow control valve 77, or in other embodiments, the flow control valve 77 may be controlled by a separate controller in the primary heat exchanger 15. In a long, sustained performance draw, hot water in the tank 90 is eventually depleted if the primary heat exchanger 15 cannot keep up with the demand at the outlet 127, because cold water flowing into the tank 90 via the two-way port 120 exceeds hot water flowing into the tank 90 from the primary heat exchanger 15.

To this point, the water heater 810 operates in substantially identical fashion to the water heater 10 of the first embodiment. This embodiment of the water heater 810 differs from the first embodiment 10, however, in how it reacts to hot water depletion. In the first embodiment, the user was obligated to stop the performance draw by turning off the faucet 127, and wait for the water heater 10 to recover. In this embodiment 810, when the second temperature sensor 825 senses that water temperature at the top of the tank 90 has dropped below a second temperature limit indicative of hot water depletion, the second temperature sensor 825 generates a second signal to the controller 830. In response to receiving the second signal, the controller 830 actuates the proportional valve 835 to restrict cold water flow into the bottom of the tank 90 through the two-way port 120.

As the hydraulic resistance is increased in the proportional valve 835, the flow rate of hot water out of the tank 90 may exceed the supply of hot water from the primary heat exchanger 15, in which case more cold water is delivered into the tank 90 through the two-way port 120. The hot water supplied by the primary heat exchanger 15 flows substantially directly through the storage tank 90 (across the top portion of the tank 90) to the secondary water outlet 115 connected to mixing valve 125. The result of restricting flow into the tank 90 through the two-way port 120 and forcing most or substantially all cold water to flow through the primary heat exchanger 15 is that the flow rate of hot water supply at the faucet 127 will be substantially limited to the flow rate permitted by the flow restrictor 77. One advantage that this alternative control system 35' has over the control system 35 of previous embodiments is that the water heater 810 will provide an "endless" supply of hot water, although the flow rate of such hot water may be restricted (i.e., as required by the primary heat exchanger 15 to achieve sufficiently high temperatures) after the tank 90 is depleted.

When the draw ends, the flow sensor 840 generates a recharge signal to the controller 830. In response to receiving the recharge signal, the controller 830 opens the proportional valve 835, and if the water temperature in the tank 90 requires reheating, activates the pump 130 (or continues to operate the pump 130 if it was already activated during the just-ended performance draw). The pump 130 recirculates the water from two-way port 120 of the tank 90, through the primary heat exchanger 15, and back to the tank 90 through the secondary water inlet 110 until the water temperature in the storage tank 90 has recovered a desired temperature (which may be set above the first and/or second temperature limits).

The controller 830 also communicates with the high limit switch 845. The high limit switch 830 is in or upstream of the flue gas exhaust 105. In this embodiment 810, the air moving device 145 may take the form of an exhaust fan. The high limit switch 830 detects the temperature of the flue gas 85 flowing between the fan 145 and the flue gas exhaust 105, and shuts down the water heater 810 if the flue gas temperature exceeds the temperature for which the exhaust duct 160 material, fan 145, or other component is rated.

In this embodiment 810, the flue gas circulation tube 140 connects the primary heat exchanger 15 to the lower portion of the secondary heat exchanger 20, and the flue gas flows from the lower portion to the upper portion of the secondary heat exchanger 20. A connection tube 850 communicates between the secondary heat exchanger 20 and the exhaust fan

145. Condensate is permitted to drip out of the connection tube 850 and the fan 145 (via conduit 855) into a condensate drain trap 860.

Various features and advantages of the invention are set forth in the following claims.

What is claimed is:

1. A tank-tankless water heater comprising:

a combustor for the production of hot flue gases;

a primary heat exchanger including a core and a flue gas flow path; and a secondary heat exchanger including a tank and at least one flue;

wherein flue gases flow from the combustor through the flue gas flow path and then through the at least one flue;

wherein water to be heated first flows through the core, then into the tank where the water is stored, and then flows out of the tank for use upon demand; and wherein heat is transferred from the flue gases to the water first as the water flows through the core and the flue gases flow through the flue gas flow path, and again as the water is stored in the tank and the flue gases flow through the at least one flue;

wherein the primary heat exchanger includes a primary water inlet and a primary water outlet;

wherein the secondary heat exchanger includes a secondary water inlet communicating with the primary water outlet for receiving hot water from the primary heat exchanger, a secondary water outlet through which hot water flows out of the tank for use upon demand, and a two-way port;

the water heater further comprising a tee communicating between the primary water inlet and the two-way port, and adapted to communicate with a source of cold water;

wherein upon demand replacement cold water from the source of cold water replaces hot water drawn from the tank; and wherein at least some of the replacement cold water flows through the two-way port into the tank without flowing through the primary heat exchanger;

the water heater further comprising means for increasing the flow of cold water from the tee to the primary water inlet and decreasing the flow of cold water from the tee to the two-way port;

wherein cold water is introduced to a bottom portion of the tank through the two-way port; and wherein water is introduced to a top portion of the tank from the primary heat exchanger.

2. The water heater of claim 1, wherein the primary heat exchanger is a temperature controlled heat exchanger having a flow control valve operable to selectively restrict flow of water through the core to achieve a desired water temperature at the primary water outlet.

3. The water heater of claim 1, wherein the primary heat exchanger is a temperature differential controlled heat exchanger in which the temperature of water flowing through the core from the primary water inlet to the primary water outlet is raised a substantially fixed amount.

4. The water heater of claim 1, further comprising a water pump communicating between the tank and the core and operable to move water from the tank, through the core, and back to the tank, to heat the water and raise the temperature of water in the tank.

5. The water heater of claim 4, wherein the water pump is operable to move water from a bottom portion of the tank, then through the core, and then to a top portion of the tank.

6. The water heater of claim 4, further comprising a temperature sensor sensing water temperature in the tank, the temperature sensor activating the water pump in response to the water temperature in the tank falling below a set point temperature.

7. The water heater of claim 1, further comprising a flow activation controller operable to initiate operation of the combustor in response to water flow through the core.

8. The water heater of claim 1, further comprising a water flow circuit operable, in response to a performance draw of hot water from the tank, to draw hot water from the tank at a first temperature, mix the hot water with cold water to produce reduced temperature water at a temperature lower than the first temperature, flow the reduced temperature water through the primary heat exchanger to produce reheated water at a second temperature substantially equal to the first temperature, and returning the reheated water to the tank.

9. The water heater of claim 1, further comprising a temperature sensor generating a signal in response to water temperature in the tank falling below a set point during continued flow of water out of the tank for use; a water pump; and a controller activating the pump in response to receiving the signal to direct an increased amount of cold water from the tee to the primary water inlet and thereby reduce the amount of cold water entering the tank through the two-way port.

10. The water heater of claim 1, further comprising a temperature sensor generating a signal in response to water temperature in the tank falling below a set point during continued flow of water out of the tank for use; and wherein the means include a controller restricting cold water flow through the two-way port into the tank in response to receiving the signal, to increase an amount of cold water flowing through the primary heat exchanger prior to entering the tank after the signal is generated.

11. A tank-tankless water heater comprising:

a combustor for the production of hot flue gases;

a primary heat exchanger including a core and a flue gas flow path; and a secondary heat exchanger including a tank and at least one flue;

wherein flue gases flow from the combustor through the flue gas flow path and then through the at least one flue;

wherein water to be heated first flows through the core, then into the tank where the water is stored, and then flows out of the tank for use upon demand; and wherein heat is transferred from the flue gases to the water first as the water flows through the core and the flue gases flow through the flue gas flow path, and again as the water is stored in the tank and the flue gases flow through the at least one flue;

the water heater, further comprising a first sensor coupled to a lower portion of the tank for generating a first signal indicative of water temperature within the lower portion of the tank;

a second sensor coupled to an upper portion of the tank for generating a second signal indicative of water temperature within the upper portion of the tank;

a two-way port communicating with the lower portion of the tank;

a cold water supply line communicating with both a primary water inlet and the two-way port;

a proportional valve communicating between the cold water supply line and the two-way port; and a water pump communicating between the cold water supply line and the primary heat exchanger;

wherein cold water flows into the tank through the two-way port during initial performance draw of hot water from the tank;

wherein the water pump is energized in response to the first sensor generating the first signal, such that a portion of cold water from the cold water supply line flows through the primary heat exchanger before reaching the tank; and wherein the proportional valve restricts flow of cold water through the two-way port in response to the second sensor generating the second signal.

12. The water heater of claim 11, further comprising a flow sensor monitoring the flow of hot water during a performance draw; wherein the flow sensor causes the proportional valve to increase the flow of cold water through the two-way valve in response to the performance draw ending.

13. The water heater of claim 11, wherein the pump draws water from the tank through the two-way port, flows the water through the primary heat exchanger where the water is reheated, and returns the reheated water to the tank in the absence of a performance draw in response to at least one of the first and second signals being generated.

14. The water heater of claim 11, wherein the at least one flue extends between a top portion and bottom portion of the tank; and wherein flue gases flow up through the at least one flue from the bottom portion to the top portion of the tank.

* * * * *